United States Patent [19]

Taglianetti et al.

[11] 4,449,341

[45] May 22, 1984

[54] FIRE CONTAINMENT ARRANGEMENT FOR CURTAIN WALL CONSTRUCTION

[75] Inventors: Philip C. Taglianetti, Brooklyn; Andrew M. Burkard, Port Washington, both of N.Y.

[73] Assignee: PPG Industries, Inc., Pittsburgh, Pa.

[21] Appl. No.: 364,285

[22] Filed: Apr. 1, 1982

[51] Int. Cl.[3] ..... E04B 1/74; E04H 1/04

[52] U.S. Cl. ..... 52/235; 52/236.6; 52/317; 52/404

[58] Field of Search ..... 52/235, 403, 404, 486, 52/489, 305, 304, 788, 789, 790, 791, 236.6, 317

[56] References Cited

U.S. PATENT DOCUMENTS

| | | | |
|---|---|---|---|
| 175,934 | 4/1876 | Collingwood | 52/307 |
| 1,870,721 | 8/1932 | Foltz | 52/486 |
| 3,110,131 | 11/1963 | Jeffress | 52/235 |
| 3,248,836 | 5/1966 | Monk et al. | 52/235 |
| 3,319,388 | 5/1967 | Olsen | 52/235 |
| 3,357,144 | 12/1967 | Chauveau et al. | 52/235 |
| 3,715,848 | 2/1973 | Jordan | 52/235 |
| 3,786,604 | 1/1974 | Kramer | 52/317 |
| 3,994,107 | 11/1976 | Aughet | 52/235 |
| 4,221,095 | 9/1980 | Weinal | 52/489 |

FOREIGN PATENT DOCUMENTS

| | | | |
|---|---|---|---|
| 2315213 | 10/1973 | Fed. Rep. of Germany | 52/235 |
| 2262890 | 7/1974 | Fed. Rep. of Germany | 52/235 |
| 2024908 | 1/1980 | United Kingdom | 52/235 |
| 480814 | 10/1975 | U.S.S.R. | 52/235 |

OTHER PUBLICATIONS

"Thermafiber" Fire Safety Systems SA-707, U.S. Gypsum Co., Chicago, Ill., 1980.

*Primary Examiner*—John E. Murtagh
*Assistant Examiner*—Michael Safavi
*Attorney, Agent, or Firm*—Dennis G. Millman

[57] ABSTRACT

In a curtain wall building structure, an improved fire containment arrangement is provided by supporting curtain wall insulation sheets and safing insulation directly to the periphery of the floor slab structure by means of a heat resistant clip.

11 Claims, 5 Drawing Figures

FIRE CONTAINMENT ARRANGEMENT FOR CURTAIN WALL CONSTRUCTION

BACKGROUND OF THE INVENTION

In high rise building construction an important consideration is to provide containment of a fire to its floor of origin. One area of particular concern is the perimeter of each floor where there is typically a gap between the floor slab and the exterior curtain wall structure. At this location, any opening provides a ready path for fire to spread to the level above. Therefore, it has been known to plug any openings between the curtain wall and the floor perimeter with heat resistant insulating materials. These insulating materials have included sheets of curtain wall insulation that cover the interior of the spandrel area of the curtain wall, as well as "safing" which is inserted into any openings between levels and, in particular, into the gap between the curtain wall insulation and the perimeter of the floor slab.

A shortcoming of the typical fire containment insulation arrangements of the prior art is that they rely upon the curtain wall structure for support. The relatively lightweight materials (e.g., aluminum) from which curtain wall framing members are typically constructed often provide considerably less heat resistance than the fire containment insulation itself. As a result, it is sometimes found that failure of the fire containment arrangement occurs when the insulation falls out of position due to softening of the curtain wall members to which it was attached. The present invention overcomes this drawback thereby providing fire containment of greater duration.

SUMMARY OF THE INVENTION

In the present invention fire containment insulation is supported independently from the curtain wall, thereby providing a greater period of time in which fire is prevented from spreading past the floor perimeter to the level above. The arrangement employs curtain wall insulation panels and safing, and critical support for both is provided by the floor slab or heat resistant structural elements associated therewith. A preferred mode of providing this support employs modified safing impaling clips, each of which has one end engaging an edge of the floor slab structure and the other end supporting both the safing and the curtain wall insulation. Each impaling clip has a horizontal leg of sufficient length to extend beyond the safing and to penetrate the curtain wall insulation. By providing the clips of a relatively heat resistant material such as steel, the clips provide a durable support for the safing and the curtain wall insulation that is independent of the curtain wall structure, thereby extending the period of time during which the integrity of the fire containment arrangement is maintained.

THE DRAWINGS

DETAILED DESCRIPTION

Figure 1:
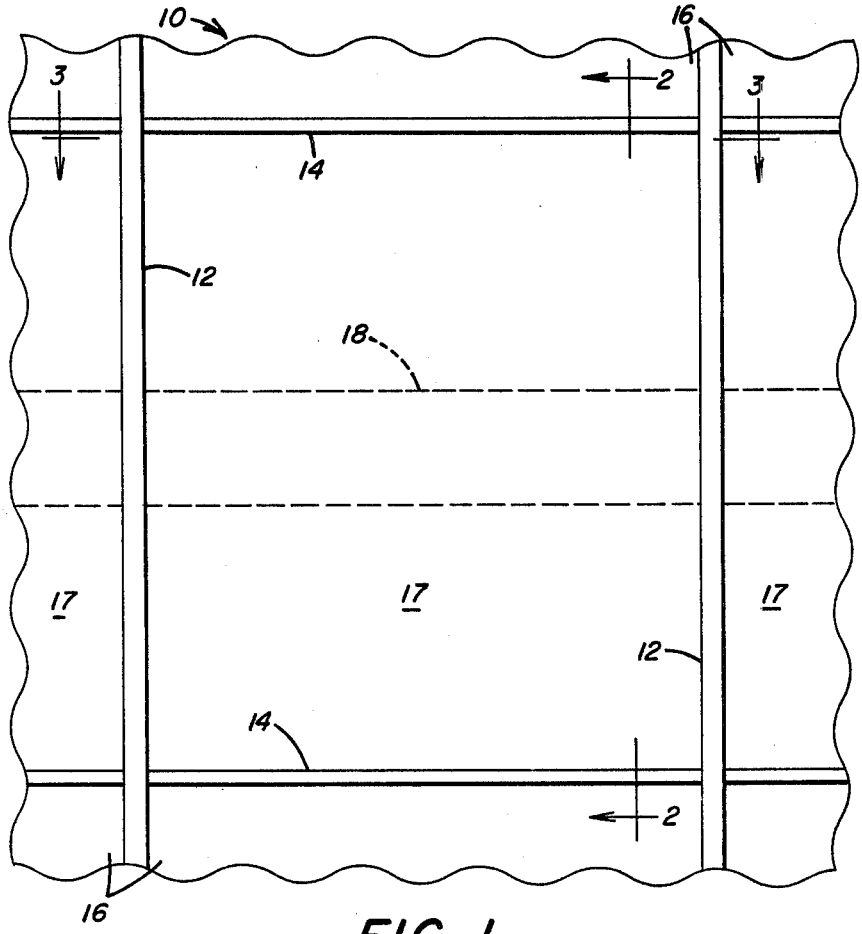
FIG. 1 is an exterior elevation of a portion of a conventional curtain wall of the type which may include the fire containment arrangements of the present invention.
Figures 2, 4, 5:
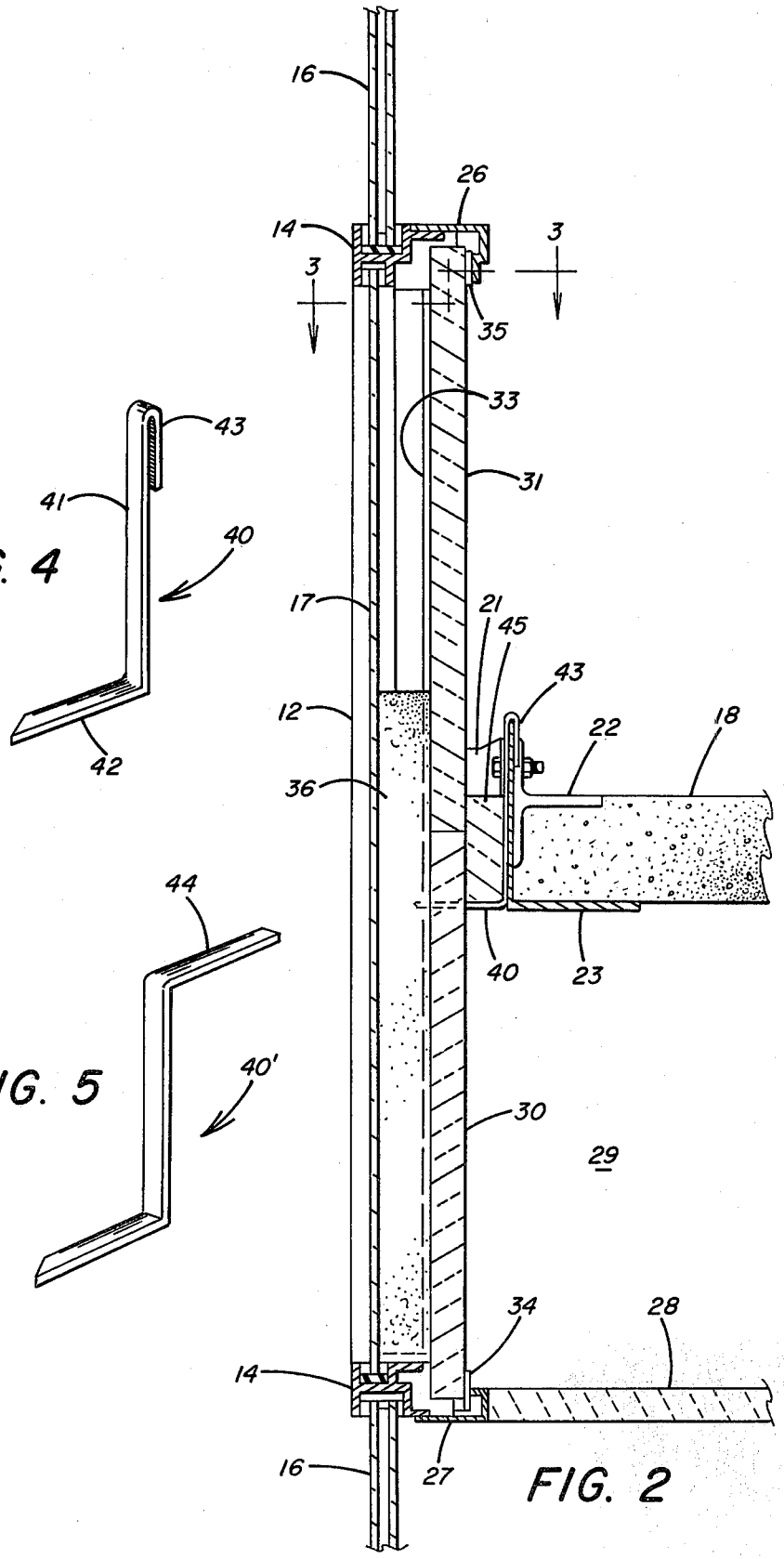
FIG. 2 is an enlarged vertical cross-sectional view of the spandrel glazing and floor perimeter area of the curtain wall construction of FIG. 1, taken along line 2—2 in FIG. 1, showing a preferred embodiment of the present invention.
FIG. 4 is an enlarged view of a preferred embodiment of an impaling clip of the type used in the embodiment of FIGS. 2 and 3.
FIG. 5 is an enlarged view of an alternative embodiment of an impaling clip which may be used with other typical floor perimeter constructions.

A typical curtain wall construction 10, an exterior fragment of which is depicted in FIG. 1, is usually comprised of vertical mullions 12 and horizontal mullions 14 which frame vision areas 16 and spandrel areas 17. The vision areas are usually glazed with clear glass, while the spandrel areas are glazed with spandrel panels that are opaque so as to conceal unsightly structural elements, such as the perimeter of a floor slab 18. It should be understood that the present invention may be used in conjunction with a wide variety of conventional curtain wall constructions as are known to those of skill in the art. Therefore, the type of curtain wall shown and described here is merely exemplary and is shown somewhat schematically, since details of the curtain wall elements themselves do not critically affect the present invention. Likewise, the type of vision glazing units 16 or spandrel glazing units 17 is not critical to the present invention and any type known in the art may be employed, including either single glazed or multiple glazed. A typical configuration is shown in FIG. 2 where the vision glazing units 16 are double glazed and the spandrel glazing unit 17 is single glazed. The spandrel glazing unit 17 may be an opaque sheet such as metal, or a glass sheet provided with an opaque coating or combinations of transparent reflective and opaque coatings. A spandrel glazing unit may also be comprised of combinations of a transparent glass sheet and an opaque sheet or panel. In the arrangement shown in the drawings, the spandrel unit 17 may typically comprise a transparent glass sheet with an opaque coating on its inside surface of baked-on frit.

The curtain wall may be fastened to a floor slab 18 in a variety of ways. In the example shown in the drawings, the attachment is by means of a bracket 21 extending from each vertical mullion 12 and bolted to a horizontal insert 22 at the edge of the floor slab. A sheet metal (usually steel) curb 23 may be fastened around the perimeter of the floor slab. On the interior side of the curtain wall, window frame trim moldings 26 and 27 may be provided. Below the slab 18 there may be provided a suspended ceiling 28 for the level below, leaving a utility space 29 between the floor slab 18 and the suspended ceiling 28. It is in this region that fire containment is critical. Fire within the utility space 29, or penetrating into the utility space through the suspended ceiling 28 from the level below, would have a free path between the curtain wall and the edge of the floor slab 18 to the level above if fire containment insulation were not in place. It is also desirable to prevent fire from breaking through the spandrel glazing unit to the outside of the curtain wall.

Figure 3:
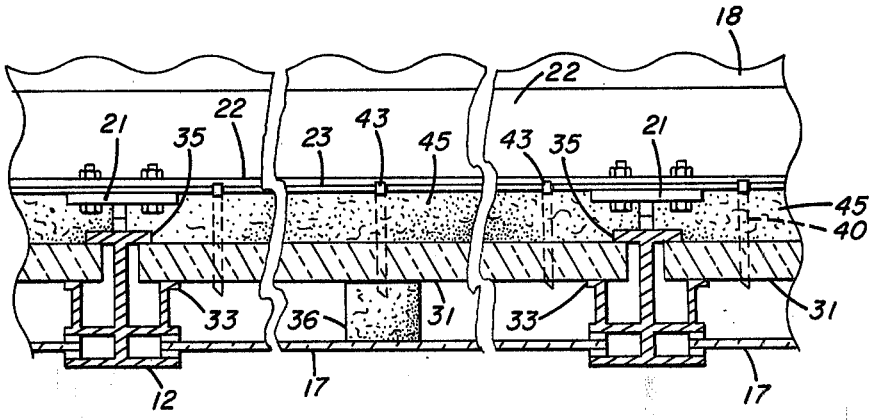
FIG. 3 is a horizontal cross-sectional view of the spandrel glazing structure of FIG. 2, taken along line 3—3 in FIG. 2.

For these reasons it has been conventional to employ sheets of curtain wall insulation to cover the inside of the spandrel glazing area. These curtain wall insulation sheets were typically clipped or pinned to the curtain wall mullions. In the present invention, the curtain wall insulation may be provided as two separate sheets 30 and 31 for ease of installation, and may be a commercially available mineral wool product such as that sold by U.S. Gypsum Co. under the trade name "Thermafiber." Both sheets 30 and 31 are restrained against horizontal movement toward the spandrel unit 17 by means of a flange 33 extending from the vertical mullions 12 (see FIG. 3). Tabs 34 and 35, also projecting from the vertical mullions, help to restrain the curtain wall insulation sheets from horizontal movement toward the interior of the building. The bottom curtain wall insulation sheet 30 may be inserted first by laying it against the side flanges 33 and compressing its lower corners between the flanges 33 and tabs 34. In the particular arrangement depicted, outward bowing of the sheets 30 and 31 in the region of their junction is prevented by providing a strip of similar insulation 36 into the space between the sheets 30 and the spandrel panel 17 with the strip 36 oriented vertically and overlapping the junction between the sheets 30 and 31. The strip 36 may be in place before inserting sheet 30. Other means for providing rigidity at this location may be employed, such as a rigid channel member extending horizontally across the spandrel area along the junction of the sheets 30 and 31. Before placing sheet 30, at least one impaling clip 40 (typically 3 or 4) is inserted into the sheet 30 to extend at least part of the way therethrough, and as the sheet 30 is lowered the upper end of the impaling clip is hooked over the curb 23.

Details of an impaling clip 40 are shown enlarged in FIG. 4. There, it may be seen that the clip is comprised of a vertical leg 41 and a horizontal leg 42, the horizontal leg preferably having a sharpened tip to expedite penetration into the curtain wall insulation sheet 30. The upper end of the vertical leg 41 may be provided with a bent portion 43 which may hang on the upstanding portion of the curb 23. In building structures not provided with a curb, the alternative impaling clip 40' shown in FIG. 5 may be employed. There, the bent portion at the upper end is replaced by a flat horizontal portion 44 which may rest on the top surface of a floor slab.

Following insertion of the insulation sheet 30, the upper curtain wall insulation sheet 31 may be inserted by compressing its upper corners between the flanges 33 and tabs 35. Then, to completely seal the perimeter of the floor slab, a block of safing insulation material 45 is compressed into the remaining space between the curtain wall insulation sheets 30 and 31 and the edge of the floor slab 18. The safing may be the same mineral wool product sold under the trade name "Thermafiber" by U.S. Gypsum Co. The horizontal length of the impaling clips 40 provide vertical support for the safing 45.

It may be noted that the curtain wall in the arrangement described herein does not provide critical support for the fire containment insulation. The flanges 33 and tabs 34 and 35, while providing proper orientation for the curtain wall insulation sheets 30 and 31 during installation, are not essential for maintaining integrity of the fire barrier. Rather, the critical elements, the insulation sheet 30 and the safing 45, are supported by the impaling clips 40. The impaling clips, by virtue of their being fabricated from heat resistance materials (e.g., 20 gauge galvanized steel), withstand the heat of a fire longer than the typical curtain wall mullion elements. Thus, in a situation where the mullions surrounding the spandrel area 17 are becoming distorted with heat from a fire, the sheet 30 and safing 40 would remain in place, thereby maintaining an effective fire barrier between the floor slab 18 and the bottom of the spandrel area. Improved vertical support is provided to the upper curtain wall insulation sheet 31 by virtue of its resting on the lower sheet 30; however, stability of the upper sheet 31 is not as critical as that of the lower sheet 30. The specific arrangement described here was subjected to fire exposure in accordance with ASTM procedure E119 and withstood one hour exposure without permitting passage of flames.

Other variations and modifications as are known to those of skill in the art may be resorted to without departing from the scope of the invention as defined by the claims which follow. We claim:

1. In a multi-level building having an elevated floor slab structure and an exterior curtain wall that includes spandrel glazing panels mounted opposite and spaced from the pheriphery of the floor slab structure; a fire containment arrangement comprising: a fire resistant insulation sheet between a spandrel glazing unit and the floor slab structure extending parallel to the spandrel glazing unit and covering substantially the area of the spandrel glazing panel below the level of the floor slab structure, heat resistant means supporting the insulation sheet on the floor slab structure independently from the curtain wall, and a body of fire resistant material filling space between the insulation sheet and the perimeter of the floor slab structure, whereby paths for fire propagation around the periphery of the floor slab structure in the spandrel area are blocked.

2. The structure of claim 1 wherein the heat resistant means supporting the insulation sheet comprise a clip, a portion of which penetrates the insulation sheet and another portion of which engages the floor slab structure.

3. The structure of claim 1 wherein the body of fire resistant material comprises compressible insulation.

4. The structure of claim 2 wherein the body of fire resistant material is supported by the clip.

5. The structure of claim 1 wherein each insulation sheet is supported by a plurality of clips.

6. The structure of claim 1 wherein a second insulation sheet is associated with each spandrel glazing panel and covers substantially the area of the spandrel glazing panel above the floor slab structure.

7. The structure of claim 2 or 4 wherein each clip has a central vertical portion, a horizontal lower portion penetrating the insulation sheet, and an upper portion engaging the floor slab structure.

8. The structure of claim 7 wherein the floor slab structure includes a vertically upstanding curb member, and the upper portion of each clip engages the curb member.

9. The structure of claim 7 wherein the upper portion of each clip is horizontal and rests on the upper surface of the floor slab structure.

10. The structure of claim 7 wherein the clip is made of steel.

11. The structure of claim 1 wherein there is a space between the insulation sheet and the spandrel glazing panel and spacing is maintained therebetween by a body of insulation material inserted into the space.

* * * * *